United States Patent [19]

Takei et al.

[11] 4,431,722

[45] Feb. 14, 1984

[54] PHOTOSENSITIVE ELEMENT FOR ELECTROPHOTOGRAPHY PRODUCED BY SUBLIMATION

[75] Inventors: Yoshiaki Takei; Yoshihide Fujimaki; Naoko Akashi; Hiroyuki Nomori, all of Hachioji, Japan

[73] Assignee: Konishiroku Photo Industry Co., Ltd., Tokyo, Japan

[21] Appl. No.: 311,658

[22] Filed: Oct. 15, 1981

[30] Foreign Application Priority Data

Oct. 16, 1980 [JP] Japan ..... 55-143699

[51] Int. Cl.[3] ..... G03G 5/14

[52] U.S. Cl. ..... 430/57; 430/58; 430/128; 430/135; 260/706

[58] Field of Search ..... 430/58, 57, 59, 128, 430/71, 135; 260/706, 707

[56] References Cited

U.S. PATENT DOCUMENTS

| | | | |
|---|---|---|---|
| 1,329,717 | 12/1919 | Andrews | 260/706 X |
| 2,687,410 | 8/1954 | Hanke | 260/707 X |
| 2,844,581 | 7/1958 | Manger et al. | 260/707 X |
| 3,850,630 | 11/1974 | Regensburger | 430/58 |
| 3,996,049 | 12/1976 | Rochlitz | 430/128 |

*Primary Examiner*—John D. Welsh

*Attorney, Agent, or Firm*—Jordan B. Bierman; Linda Bierman

[57] ABSTRACT

Disclosed is a photosensitive element for electrophotography comprised of a layered structure having a polycyclic quinone pigment dispersed in an organic resin binder as a charge generating layer and an organic charge transport layer mixed with a resin binder.

10 Claims, 8 Drawing Figures

PHOTOSENSITIVE ELEMENT FOR ELECTROPHOTOGRAPHY PRODUCED BY SUBLIMATION

The present invention relates to a photosensitive element for electrophotography.

There have heretofore been known those photosensitive elements for electrophotographies in which organic pigments are used as carrier generating materials composing the photosensitive layer thereof or as carrier generating materials having a carrier transport function. Such organic pigments are mostly those (1) commercially available, (2) obtained by subjecting commercially available pigments to washing treatments, and (3) synthesized independently.

(1) Commercially available organic pigments, since they contain impurities such as byproducts, surfactants, inorganic salts and the like, are unable to endow sufficient photosensitivity to the resultant photosensitive element. Even if a sufficiently photosensitive element is obtained, the charged carrier produced would be trapped due to the impurities present in the photosensitive layer, and the residual potential therein would accumulate as it is repeatedly used causing fog on the reproduced image.

(2) The photosensitive element for electrophotography which uses an organic pigment subjected to a washing treatment still contains considerable amounts of impurities because the foregoing impurities cannot be removed completely by washing; particularly, removal of the surfactant is nearly impossible, thus causing a defect similar to that of (1).

(3) Even in the case of organic pigments synthesized independently, many of them generally have low solubility in solvents, so that the impurities therein can hardly be removed by recrystallization, and the catalyst, unreacted materials, and byproducts which have been applied to the synthesis reaction are not completely removable, thus bringing about a defect similar to that of (1).

Meanwhile, some organic pigments are sublimable. There have been known photosensitive elements for electrophotography provided with a carrier generating layer comprised of a vacuum deposition of the organic pigment. The carrier generating layer thus formed is one composed of an impurity-free organic pigment minutely accumulated, so that it gives a relatively high sensitivity even in the form of a thin layer. In this respect, it can be considered favorable. However, the production of such a carrier generating layer requires a large scale of vacuum deposition apparatus in which it is extremely difficult to control the thickness and uniformity of the layer over the entire area of the conductive support, and accordingly costs a great deal. In addition, the adhesiveness of the deposited layer of the organic pigment to the support is small, and the strength of the pigment is also small in itself, so that such defects as scratches tend to be produced on the layer. This results in many restrictions on the whole photosensitive composition. Furthermore, there are many cases where the addition of appropriate additives is effective to improve the characteristics of the pigment. However, in the vacuum deposition process, there is a limit to the kind and quantity of materials to be used as well as a difficulty in uniformly mixing such materials in the pigment, so that the improvement in the characteristics is nearly infeasible. It is the present state of the art that such photosensitive elements for electrophotography as having substantially satisfactory characteristics produced by the use of organic pigments are still not provided.

It is an object of the present invention to provide a photosensitive element for electrophotography which uses an organic pigment and which is excellent in the characteristics useful for the manufacture and use as well as in the electrophotographic characteristics.

In the present invention the photosensitive element for electrophotography is of a composition comprising a photosensitive layer composed of a pigment-containing layer obtained by coating a liquid containing a refined pigment produced by the sublimation of a sublimable organic pigment.

Organic pigments usable in the present invention may be those refined by sublimation, so that any sublimable organic pigments may be used as the materials for the refinement. Typical examples of sublimable organic pigments include: (1) azo pigments such as a monoazo pigment, a polyazo pigment, a metallic complex azo pigment, pyrazolone-azo pigment, a stilbene-azo pigment, a thiazole-azo pigment and the like, (2) perylene pigments such a perylenic acid anhydride, perylenic acid imide and the like, (3) anthraquinone or polycyclic quinone pigments such as anthraquinone derivatives, anthanthrone derivatives, dibenzpyrenequinone derivatives, pyranthrone derivatives, violanthrone derivatives, isoviolanthrone derivatives, and the like, (4) indigoid pigments such as indigo derivatives, thioindigo derivatives and the like, (5) phthalocyanine pigments such a metallic phthalocyanine, metal free phthalocyanine, and the like, (6) perynone pigments such as bisbenzimidazole derivatives and the like, (7) quinacrydone pigments, (8) cyanine and merocyanine pigments, and (9) quinoline pigments.

These examples of pigments are disclosed in, for example, Japanese Patent Publication Open to Public Inspection (hereinafter referred to as Japanese Patent O.P.I. Publication) No. 48334/1974, No. 128734/1974, No. 75042/1975, No. 18544/1972, etc.

BRIEF DESCRIPTION OF THE DRAWINGS

1 . . . Conductive support
2 . . . Binder resin
3 . . . Sublimated organic pigment
4 . . . Photosensitive layer
5 . . . Carrier generating layer 6 . . . Carrier transport layer
61 . . . Carrier transport phase
7 . . . Interlayer
1A . . . Insulating base
1B . . . Conductive layer Examples of the photosensitive element for electrophotography of the present invention are illustrated in the accompanying drawings. As shown in FIG. 1, a conductive support 1 is coated thereon with a coating liquid prepared by dispersing a sublimated organic pigment into a binder resin solution, whereby a photosensitive layer 4 is formed whose binder resin 2 contains an organic pigment 3 dispersed therein.

Resins usable as the above-mentioned binder include, for example, such addition polymerization type resins, polyaddition type resins and polymerization-condensation type resins as polyethylene, polypropylene, acryl resin, methacryl resin, vinyl chloride resin, vinyl acetate resin, epoxy resin, polyurethane resin, phenol resin, polyester resin, alkyd resin, polycarbonate resin, silicone resin, melamine resin and the like, and such copolymer resins containing two or more of the repeating units of these resins as, e.g., vinyl chloride-vinyl acetate copolymer resin, vinyl chloride-vinyl acetate-maleic anhydride copolymer resin and the like. However, resins usable as the foregoing binder are not limited to these resins but all resins used for such purposes may be used.

Figure 1:
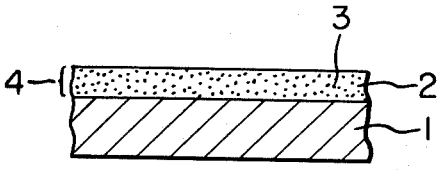
FIG. 1 is an explanatory enlarged sectional view showing an example of the composition of the photosensitive element for electrophotography of the present invention.
Figure 2:
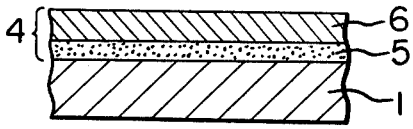
Figure 3:
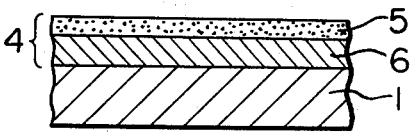

And in the present invention, photosensitive layer 4 may be formed either by, as shown in FIG. 2, providing on conductive support 1 a carrier generating layer 5 containing the foregoing organic pigment, the carrier generating layer having superposed thereon a light-transmissible carrier transport layer 6, or by, as shown in FIG. 3, providing on conductive support 1 a carrier transport layer 6 which has superposed thereon a carrier generating layer 5. Carrier generating layer 5 may be of such a composition that the foregoing organic pigment is dispersedly contained in a binder resin just as photosensitive layer 4 in FIG. 1 is, but particularly in the example shown in FIG. 2, the layer may be composed of the foregoing pigment alone formed by coating and drying a coating liquid prepared by dissolving or dispersing the foregoing organic pigment into an appropriate solvent or dispersant.

And to carrier generating layer 5 in the example of the two-layer composition may be added a carrier transport material having a large movable degree to a carrier of specific or non-specific polarity, and as such a carrier transport the carrier transport material which composes carrier transport layer 6 may likewise be used. In addition, carrier generating layer 5 may at need contain a residual potential reducing agent, exhaustion reducing agent and the like.

The thickness of carrier generating layer 5 thus formed should be preferably from 0.005 to 20 microns, most preferably from 0.1 to 5 microns.

Carrier transport layer 6 in the above example may be formed on the foregoing carrier generating layer 5 or on conductive support 1 by coating a liquid prepared by dissolving a carrier transport material at need together with an appropriate binder resin and other additives into an appropriate solvent.

Carrier transport materials may generally be classified as electron donors and electron acceptors, which are selected arbitrarily from numerous organic compound groups.

Electron donors usable in this invention include, e.g., condensation polycyclic compounds such as anthracene, 2,6-dimethyl anthracene, 2-phenyl anthracene, phenanthrene, 9-aminophenanthrene, pyrene, coronene and the like; aromatic amino compounds such as diphenylamine, dinaphthylamine, N-phenyl-2-naphthylamine, triphenylamine, tri-p-tolylamine, 4-acetyl triphenylamine, N,N,N',N'-tetraphenyl-1,3(and-1,4)-phenylenediamine, N,N,N',N'-tetrabenzyl-1,3(and-1,4)-phenylenediamine, N,N,N',N'-tetra[2-methylbenzyl]-1,3(and-1,4)-phenylenediamine, N,N,N',N'-tetra[4-chlorobenzyl]-1,3,(and-1,4)-phenylenediamine, N,N,N',N'-tetraphenyl-[1,1'-biphenyl]-4,4'-diamine, N,N'-diphenyl-N,N'-bis-[3-methylphenyl]-[1,1'-biphenyl]-4,4'-diamine, N,N'-diphenyl-N,N'-bis-[3-cholorophenyl]-[1,1'-biphenyl]-4,4'-diamine, 1,1-bis-[4-N,N,-dibenzylaminophenyl]nomalbutane, 1,1-bis-[4-N,N-dibenzylamino-2-methylphenyl]-normalbutane, 1,1-bis-[4-N-ethyl-N-benzylamino-2-methoxyphenyl]-normalbutane, 1,1-bis-4-N,N-dibenzylamino-2-methoxyphenyl-normalbutane, 1,1-bis-[4-N,N-dibenzylamino-2,5-dimethoxyphenyl]normalbutane, 1,1-bis-[4-N,N-dimethylamino-2-methoxyphenyl]-2-methylpropane, 1,1-bis-[4-N,N-diethylaminophenyl]heptane, 1,1-bis-[4-N-ethyl-N-benzylaminophenyl]-1-cylohexylmethane, 1,1-bis-[4-N,N-dibenzylamino-2-methoxyphenyl]-1-cyclohexylmethane, 1,1-bis-[4-N,N-diethylaminophenyl]-1-phenylmethane, 1,1-bis-[4-N,N-diethylamino-2-methylphenyl]-1-phenylmethane, 1,1-bis-[4-N-morpholinophenyl]-1-[2-furyl]methane, 1,1-bis-[4-N,N-dibenzylaminophenyl]cyclohexane, 1,1-bis-[4-N,N-dimethylamino-2-methylphenyl]cyclohexane, 1,1-bis-[4-N,N-dibenzylamino-2-methylphenyl]cyclohexane, 4,4'-bis-[N,N-diethylamino]-tetraphenyl-methane and the like; acylhydrazone derivatives such as 4-dimethylamino benzylidene benzhydradzide, 4-dimethylaminobenzylidene-2-methylbenzoic acid hydrazide and the like; oxazole derivatives such as 2-[4-dimethylaminophenyl]-5-phenyl-oxazole, 2-[4-diethylaminophenyl]-5-phenyloxazol, 2,5-diphenyl-4-[4-dimethylaminophenyl]-oxazole, 2-[4'-dimethylaminophenyl]-benzoxazole, 2-[4'-diethylaminophenyl]-benzoxazole and the like; thiazole derivatives such as 2-[4'-diethylaminophenyl]-thiazole, 2,5-bis-[4-diethylaminophenyl]-thiazole, 2-phenyl-benzthiazole, 2-[4'-dimethylaminophenyl]-benzthiazole, 2-[4'-diethylaminophenyl]-benzthiazole and the like; imidazole derivatives such as 4-[4'-dimethylaminophenyl]-5-phenyl-imidazole, 4,5-bis-[4'-methoxyphenyl]-imidazole, 4-[4'-dimethylaminophenyl]-5-[4'-chlorophenyl]-imidazole, 2-[4'-methoxyphenyl]-4,5-diphenyl-imidazole, 2-[4'-chlorophenyl]-4,5-diphenylimidazole, 2-[4'-dimethylaminophenyl]-4',5-diphenyl-imidazole, 2-[4'-diethylaminophenyl]-4,5-diphenyl-imidazole, 1-methyl-2-[4'-diethylaminophenyl]-4,5-diphenyl-imidazole, 2-[4'-diethylaminophenyl]-benzimidazole, 1-methyl-2-[4'-diethylaminophenyl]-benzimidazole, 2-[4'-dimethylaminophenyl]-6-methoxy-benzimidazole, 1-ethyl-2-[4'-diethylaminophenyl]-6-methyl-benzimidazole, and the like; pyrazoline derivatives such as 1,3,5-triphenyl pyrazoline, 1-phenyl-3-[4'-dimethylaminostyryl]-5-[4''-dimethylaminophenyl]-pyrazoline, 1-phenyl-3-[4'-diethylaminostyryl]-5-[4''-diethylaminophenyl]-pyrazoline, 1-phenyl-3-[4'-methoxystyryl]-5-[4''-methoxyphenyl]-pyrazoline, 1,3-diphenyl-4-methyl-pyrazoline, 1-phenyl-3-[4'-diethylaminostyryl]-4-methyl-5-[4''-methoxyphenyl]-pyrazoline, 1-phenyl-3-[4'-diethylaminostyryl]-4-methyl-5-[4''-diethylaminophenyl]- pyrazoline and the like; imidazolone derivatives such as 4,5-diphenyl imidazolone, 4-[4'-dimethylaminophenyl]-5-phenyl-imidazolone and the like; imidazothione derivatives such as 4,5-diphenyl imidazothione, 4-[4'-dimethylaminophenyl]-5-phenyl imidazothione and the like; oxadiazole derivatives such as 2,5-bis-[4'-dimethylaminophenyl]-1,3,4-oxadiazole, 2,5-bis-[4'-diethylaminophenyl]-1,3,4-oxadiazole, 2,5-bis-[4'-n-propylaminophenyl]-1,3,4-oxadiazole, 2,5-bis-[4'-cyclohexylaminophenyl]-1,3,4-oxadiazole, 2,5-bis-[4'-acetylaminophenyl]-1,3,4-oxadiazole, 2-[4'-dimethylaminophenyl]-5-[4''-amino-3''-chlorophenyl]-1,3,4-oxadiazole, 2-[N,N-di-p-tolylamino]-5-[4'-diethylaminophenyl]-1,3,4-oxadiazole and the like; thiadiazole derivatives such as 2,5-bis-[4'-dimethylaminophenyl]-1,3,4-thiadiazole, 2,5-bis-[4'-diethylaminophenyl]-1,3,4-thiadiazole and the like; triazole derivatives such as 2,5-bis-[4'-dimethylaminophenyl]-1,3,4-triazole, 2,5-bis-[4'-diethylaminophenyl]-1,3,4-triazole, 1-ethyl-2,5-bis-[4'-dimethylaminophenyl]-1,3,4-triazole and the like; carbazole and carbazole derivatives such as N-ethyl carbazole, N-phenyl carbazole, benzcarbazole and the like; and poly-N-vinyl carbazole and the derivatives thereof such as nitrated poly-N-vinyl carbazole, chlorinated poly-N-vinyl carbazole, brominated poly-N-vinyl carbazole and the like.

Electron-acceptors include such compounds having large electron affinity as, e.g., succinic anhydride, maleic anhydride, dibromomaleic anhydride, phthalic anhydride, tetrachlorophthalic anhydride, tetrabromophthalic anhydride, 3-nitrophthalic anhydride, 4-nitrophthalic anhydride, pyromellitic anhydride, mellitic anhydride, tetracyanoethylene, tetracyanoquinodimethane, o-dinitrobenzene, m-dinitrobenzene, 1,3,5-trintrobenzene, paranitrobenzonitrile, picryl chloride, quinone chlorimide, chloranyl, bromanyl, dichlorodicyano-p-benzoquinone, anthraquinone, dinitroanthraquinone, 2,7-dinitrofluorenone, 2,4,7-trinitrofluorenone, 2,4,5,7-tetranitrofluorenone, 9-fluorenylidene-[dicyanomethylenemalonodinitrile], polynitro-9-fluorenylidene-[dicyanomethylenemalonodinitrile], picric acid, o-nitrobenzoic acid, p-nitrobenzoic acid, 3,5-dinitrobenzoic acid, pentafluorobenzoic acid, 5-nitrosalicylic acid, 3,5-dinitrosalicylic acid, phthalic acid, mellitic acid and the like.

Although the carrier transport layer may be composed of one or more of from the above-enumerated carrier transport materials. Such carrier transport materials as having sufficient layer formability are rarely to be obtained; most of them have no layer formability, or even if they are capable of forming layers, it is generally difficult to obtain such carrier transport layers that can withstand practical applications by themselves because their mechanical strength is small or because they cannot form layers having sufficiently high transparency. Accordingly, it is desirable that the carrier transport layer be formed by incorporating the above-mentioned carrier transport material(s) into a resin having a large compatibility therewith.

Such resins useful herein include, e.g., such addition polymerization type resins, polyaddition type resins, and polymerization condensation type resins as polyethylene, polypropylene, acryl resin, methacryl resin, vinyl chloride resin, vinyl acetate resin, epoxy resin, polyurethane resin, phenol resin, polyester resin, alkyd resin, polycarbonate resin, silicone resin, melamine resin and the like, and such copolymer resins containing two or more of the repetitive copolymer resins containing two or more of the repetitive units of these resins as, e.g., vinyl chloride-vinyl acetate copolymer resin, vinyl chloride-vinyl acetate-maleic anhydride copolymer resin and the like. However those resins usable herein are not limited to these resins described above but all resins that can generally be used for such purposes are applicable.

Carrier transport materials (electron acceptors and electron donors) may be used either singly or in various combinations of electron donors and electron acceptors. When acceptors and donors are not used singly, charge-transfer complexes may sometimes be formed between the electron donors and electron acceptors, whereby the mobility of the carrier of specific sign in the foregoing carrier transport layer may be discretionally controlled, and in addition, the internal trap may effectively vanish. The carrier transport layer may, at need, contain an appropriate plasticizer, residual potential reducing agent, exhaustion reducing agent and the like.

As aforementioned, when adding carrier transport materials to carrier-generating layer 5, the carrier transport materials constituting carrier transport layer 6 may be identical with or partly the same as the carrier transport materials constituting carrier generating layer 5, but may also be quite different materials in order to raise the function of the photosensitive element.

The thickness of carrier transport layer 6 thus formed should be preferably from 0.5 to 50 microns, most preferably from 2 to 20 microns.

Figure 4:
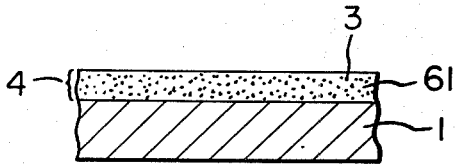
FIG. 2 to FIG. 4 are explanatory enlarged sectional views each showing a different composition of the photosensitive layer of the present invention.

Aside from the above, in the present invention, as shown in FIG. 4, a photosensitive element for electrophotography may be constituted by providing photosensitive layer 4 which is formed by incorporating the foregoing organic pigment 3 into carrier transport phase 61 containing carrier transport materials.

Figure 5:
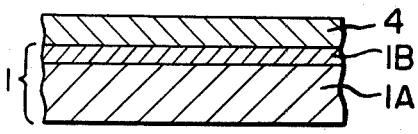
FIG. 5 is an explanatory enlarged sectional view showing a modified example of the conductive support.

In addition materials used for conductive support 1 in each of the aforementioned examples include, for example, such metals as aluminum, nickel, copper, zinc, palladium, silver, indium, tin, platinum, gold, stainless steel, brass and the like, but are not limited thereto; for example, as shown in FIG. 5, conductive support 1 may also be constituted by providing conductive layer 1B on insulating base 1A. In this case, a base 1A there may be suitably used such materials as a paper sheet, plastic sheet and the like, which have flexibility as well as sufficient strength against stress such as tensil force, while conductive layer 1B is a metal which may be provided on base 1A by laminating, vacuum deposition or the like.

Figure 6:
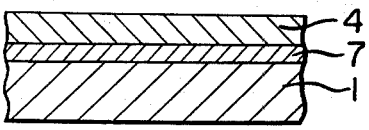
FIG. 6 is an explanatory enlarged sectional view showing another composition of the photosensitive element for electrophotography of the present invention.

Further, as shown in FIG. 6, photo-sensitive layer 4 in each of the aforesaid examples may also be formed on interlayer 7 provided on conductive support 1. Interlayer 7 serves to prevent the penetration of free carriers from conductive support 1 into photosensitive layer 4 at the time of the charging thereof, and also serves as an adhesive layer which holds photosensitive layer 4 and conductive support 1 together as a unit. As materials for interlayer 7 there may be used such metallic oxides as aluminum oxide, indium oxide, and the like, and polymers such as acryl resin, methacryl resin, vinyl chloride resin, vinyl acetate resin, epoxy resin, polyurethane resin, phenol resin, polyester resin, alkyd resin, polycarbonate resin, silicone resin, melamine resin, vinyl chloride-vinyl acetate copolymer resin, vinyl chloride-vinyl acetate-maleic anhydride copolymer resin and the like.

In the present invention, as described above, the pigment-containing layer or carrier generating layer which constitutes photosensitive layer 4 is formed by coating a liquid containing sublimated organic pigments, the coating being carried out by utilizing any discretional coating method such as the roll coating method, wire bar coating method, doctor blade coating method, dipping method, spray method and the like.

The photosensitive element for electrophotography of the present invention is thus constituted and uses a sublimated organic pigment as the carrier generating material thereof, so that there may be obtained a photosensitive element for electrophotography excellent in various characteristics for practical use; that is, in the sublimation method, the desired organic pigments can be refined in high yields by the use of relatively simple means, wherein in the case of those of crystalline nature they may be sufficiently grown to become crystallized. Furthermore, the sublimation method is capable of providing chemically pure pigments compared to the washing method or recrystallization method. Impurities are nearly completely removed therefrom, and therefore a less carrier-trapped, high speed photosensitive layer may be formed at a relatively low cost. As a result, the photosensitive element for electrophotography of the present invention allows for satisfactory images, free of fog, without the accumulation of residual potential, even in making a number of copying operations. This effect is remarkable especially in polycyclic quinone pigments such as anthanthrone, dibenzpyrene, pyranthrone, (iso)violanthrone and derivatives thereof.

Figure 7:
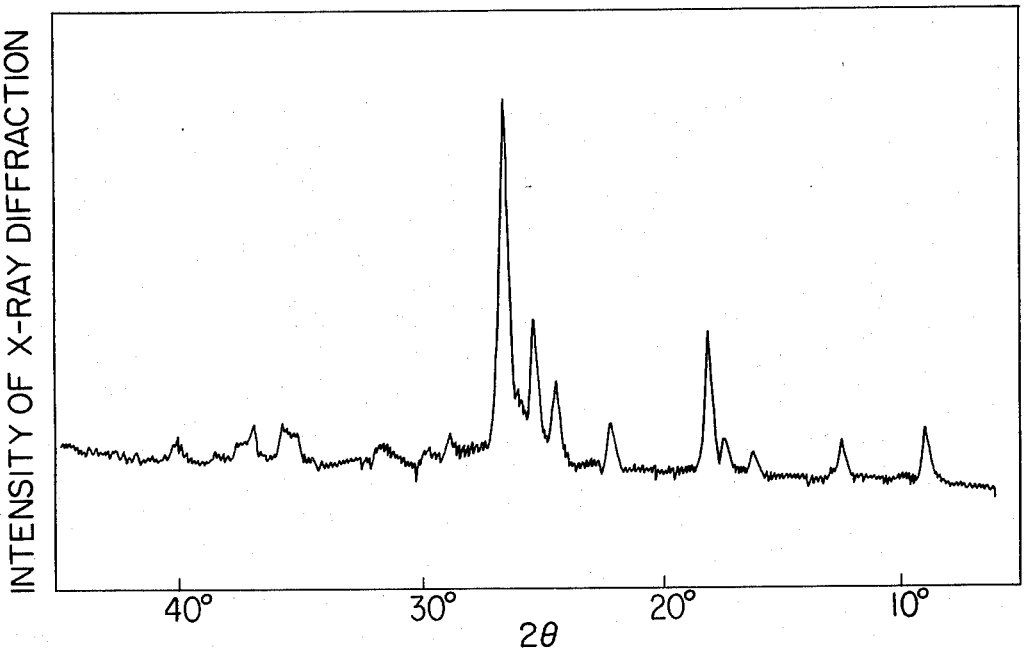
FIG. 7 is an x-ray diffraction pattern of 4,10-dibromoanthanthrone, "Monolite Red 2Y" (C.I. No. 59300, manufactured by I.C.I).
Figure 8:
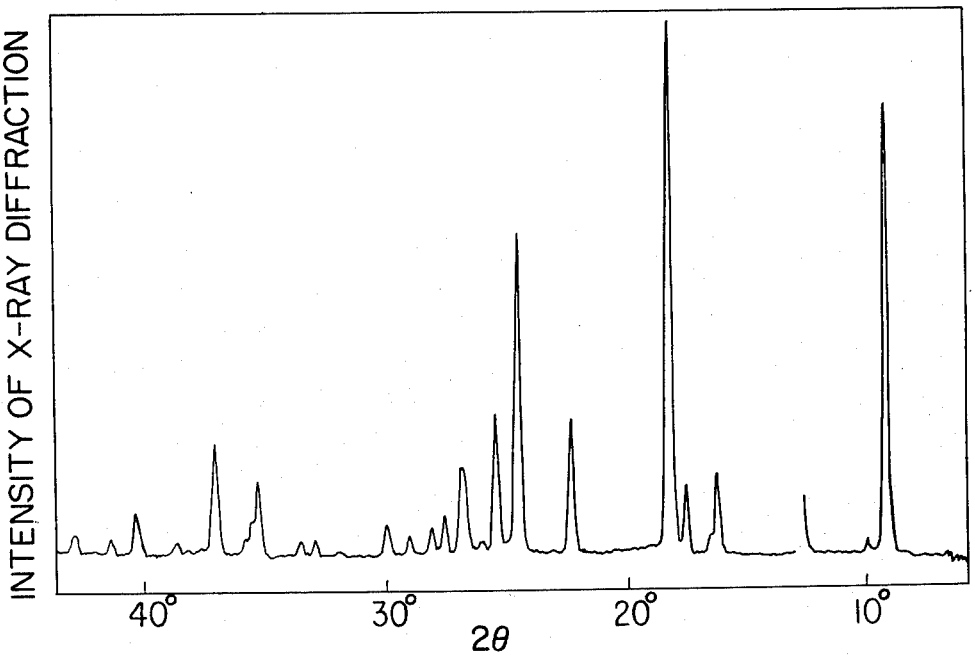
FIG. 8 is an x-ray diffraction pattern of the "Monolite Red 2Y" which was refined by sublimation.

FIG. 7 shows a x-ray diffraction pattern of 4,10-dibromoanthanthrone, "Monolite Red 2Y" (C.I. No. 59300, manufactured by and available from I.C.I) and FIG. 8 shows the pattern obtained by the use of the same compound except that in this case the compound has been purified by sublimation.

It is obvious from these two Figures that the x-ray diffraction pattern obtained by the use of the sublimation purified compound is different from that obtained by the use of the unpurified one in that the relative intensity of each peak has been strengthen and that the shape of the pattern has become much more sharp, presumably by the effect of regularization of crystal habit of the compound by sublimation.

The formation of a layer containing the above-described organic pigment is effected by coating dissolving or dispersing the pigment in a liquid and then using this to form a coating, so that a pigment-containing layer with a uniform thickness over the entire area and with less defects may be formed at a low cost. Accordingly, also in this respect, a satisfactory photosensitive element for electrophotography may be obtained.

In addition, various additives, by the addition thereof to the foregoing coating liquid, may be introduced to the pigment-containing layer, thereby giving the photosensitive element for electrophotography additional excellent characteristics; by incorporating a binder resin the resulting pigment-containing layer may be largely improved in the mechanical strength thereof as well as in the adhesion thereof to conductive support 1 and the like, thus making the photosensitive element for electrophotography highly durable. Also such a pigment-containing layer as containing a plurality of organic pigments or as containing a pigment together with a carrier-transport materials may be readily formed to thereby obtain desired sensitivity characteristics, thus enabling the control of electrophotographic image forming characteristics.

The present invention is further illustrated with reference to examples below, but the present invention is not limited thereto:

EXAMPLE 1

A commercially available polycyclic quinone pigment 4,10-dibromo-anthanthrone "Monolite Red 2Y" (C.I. No. 59300, manufactured by I.C.I.) filled in the graphite-made evaporation source provided inside a vacuum evaporator was sublimated for 5 minutes at the temperature of 350° C. to be deposited on a substrate disposed 15 centimeters above the evaporation source. 3 g of the thus obtained refined pigment was added to 100 ml of 1,2-dichloroethane and dispersed therein over a period of 48 hours by means of a ball mill to thereby obtain a carrier generating layer coating liquid. The resulting coating liquid was subsequently coated by the wire bar coating method so as to form a carrier generating layer with the thickness of 1 micron on an interlayer 0.1 micron thick composed of vinyl chloride-vinyl acetate-maleic anhydride copolymer resin provided on a conductive support formed by laminating polyethylene terephthalate film with aluminum.

On the other hand, 6 g of 1,1-bis-[4-N,N-dibenzylamino-2-methyl-phenyl]normalbutane, 5 g of poly-N-vinyl-carbazole "Luvican M170" (manufactured by BASF), 0.05 g of 2,4,7-trinitro-9-fluorenone, 0.2 g of 3,5-dinitro-benzoic acid and 3,5 g of polycarbonate resin "Panlide L-1250" (manufactured by Teijin Chemical Industry Co., Ltd.) were dissolved in a mixed solvent of 40 ml of 1,2-dichloroethane and 50 ml of monochlorobenzene, and the resulting carrier transport layer-forming coating liquid was coated by the doctor blade coating method on the foregoing carrier generating layer and then dried to form a 14-micron-thick carrier transport layer, thereby producing a photosensitive element for electrophotography (sample No. 1) of the present invention.

EXAMPLE 2

A photosensitive element for electrophotography (sample No. 2) of the present invention was prepared by forming a one-micron-thick carrier generating layer and 14-micron-thick carrier transport layer in the same manner as in Example 1 with exception that in place of the polycyclic quinone pigment in Example 1 a commercially available perylene pigment N,N'-dimethyl-perylene-3,4,9,10-tetracarboxylic acid imide "Paliogen Maroon 3920" (C.I. No. 71130, manufactured by BASF) was sublimated to be used as an organic pigment.

EXAMPLE 3

A photosensitive element for electrophotography (sample No. 3) of the present invention was produced by forming a 2-micron-thick carrier generating layer and a 14-micron-thick carrier transport layer in the same manner as in Example 1 with the exception that 3 g of the same sublimated pigment as was used in Example 1 was added to a solution of 3 g of polycarbonate resin "Panlite L-1250" (manufactured by Teijin Chemical Industry Co., Ltd.) dissolved in 100 ml of 1,2-dichloroethane and the resulting mixture was dispersed over a period of 48 hours by means of a ball mill, and the thus obtained dispersed liquid was used as a carrier generating layer coating liquid.

EXAMPLE 4

A mixture prepared by adding 10 g of the same sublimated pigment as was used in Example 1 to a solution of 10 g of a polycarbonate resin dissolved in 100 ml of 1,2-dichloroethane was dispersed by a ball mill over a period of 48 hours. The resulting liquid was used as a photosensitive layer coating liquid to be coated by the wire bar coating method so as to form a 13-micron-thick photo-sensitive layer on an interlayer provided in the same manner as Example 1 to thereby produce a photosensitive element for electrophotography (sample No. 4) of the present invention.

EXAMPLE 5

A mixture prepared by adding 3 g of the same sublimated pigment as was used in Example 1 to a solution of 10 g of polycarbonate resin and 5 g of 1,1-bis-[4-N,N-dibenzylamino-2-methyl-phenyl]normalbutane dissolved in 100 ml of 1,2-dichloroethane was dispersed over a period of 48 hours by means of a ball mill. The dispersed liquid thus obtained was used as a photosensitive layer coating liquid to be coated by the wire bar coating method so as to form a 16-micron-thick photosensitive layer on an interlayer provided in the same manner as in Example 1, whereby a photosensitive element for electrophotography (sample No. 5) of the present invention was produced.

CONTROL 1

A photosensitive Element for electrophotography (control No. 1) was produced by the formation of a one-micron-thick carrier generating layer and a 14-micron-thick carrier transport layer in an identical manner with that in Example 1 with exception that the commercially available polycyclic quinone pigment in Example 1 was used as is as an organic pigment.

CONTROL 2

A photosensitive Element for electrophotography (control No. 2) was prepared by the formation of a one-micron-thick carrier-generating layer and a 14-micron-thick carrier transport layer in quite the same manner as in Example 2 with the exception that as an organic pigment the commercially available perylene pigment in Example 2 was used as is.

CONTROL 3

A photosensitive element for electrophotography (control No. 3) was produced by the formation of a 2-micron-thick carrier generating layer and a 14-micron-thick carrier transport layer in quite the same manner as in Example 3 with the exception that as an organic pigment the commercially available polycyclic quinone pigment in Example 1 was used as is.

CONTROL 4

A photosensitive element for electrophotography (control No. 4) was produced by the formation of a 15-micron-thick photosensitive layer in quite the same manner as in Example 4 with the exception that as an organic pigment the commercially available polycyclic quinone pigment in Example 1 was used as is.

CONTROL 5

A photosensitive element for electrophotography (control No. 5) was produced by the formation of a 16-micron-thick photosensitive layer in quite the same manner as in Example 5 with the exception that as an organic pigment the polycyclic quinone pigment in Example 1 was used as is.

Each of samples No. 1 to No. 5 and control samples No. 1 to No. 5 obtained in the above-described examples and controls was set to an electrometer Model SP-428 (manufactured by Kawaguchi Electric Mfg. Co., Ltd.) to be subjected to a 5-second charging operation with the charging voltage of −6 KV, and the charged potential Vo(V) on the surface of the photosensitive layer right after the charging operation and the exposure amount $E\frac{1}{2}$ (lux.sec) required to attenuate the charged potential Vo to one half were measured. The results obtained are shown in Table 1.

TABLE 1

| Electrophotographic light-sensitive body | Vo(V) | $E\frac{1}{2}$ (lux · sec) | Thickness of light-sensitive layer (micron) CTL | CGL |
|---|---|---|---|---|
| Sample No. 1 | −738 | 2.9 | 14 | 1 |
| Sample No. 2 | −641 | 5.6 | 14 | 1 |
| Sample No. 3 | −755 | 3.2 | 14 | 2 |
| Sample No. 4 | −652 | 10.3 | 13 | |
| Sample No. 5 | −814 | 7.1 | 16 | |
| Control No. 1 | −760 | 3.6 | 14 | 1 |
| Control No. 2 | −694 | 6.7 | 14 | 1 |
| Control No. 3 | −802 | 3.9 | 14 | 2 |
| Control No. 4 | −747 | 12.5 | 15 | |
| Control No. 5 | −953 | 8.8 | 16 | |

In the above table the "CGL" represents carrier generating layers, while the "CTL" represents carrier transport layers.

Each of samples No. 1 to No. 3 and control samples No. 1 to No. 3 was set to an electrophotographic dry copying machine "U-Bix 2000R" (manufactured by Konishiroku Photo Industry Co., Ltd.) to be subjected to successive copying operations, and measurements were made by means of an electrostatic voltmeter Model 144-1D (manufactured by Monroe Electronics Inc.) on the electric potential in the image area of the photosensitive layer. The results are shown in Table 2.

TABLE 2

| Electrophotographic light-sensitive body | Electric potential in the image area (V) Initial | After 5000 copies | Increased quantity |
|---|---|---|---|
| Sample No. 1 | −93 | −128 | 35 |
| Sample No. 2 | −144 | −193 | 49 |
| Sample No. 3 | −109 | −147 | 38 |
| Control No. 1 | −122 | −174 | 52 |
| Control No. 2 | −187 | −263 | 76 |
| Control No. 3 | −135 | −192 | 57 |

As is apparent from the above results all photosensitive elements for electrophotography of the present invention containing sublimated organic pigments not only have higher sensitivities than those of the photosensitive element for electrophotography containing unrefined organic pigments but demonstrate fog-free, clear copy images because their accumulated residual potential is small and the potential increase in the image area is also small even when the copying operation is repeated a number times.

We claim:

1. A layered photosensitive element for electrophotography having a charge generating layer which comprises a dispersion of a photoconductive organic polycyclic quinone pigment produced by sublimation in an organic resin binder, a charge transport layer adjacent to said generating layer comprising an organic charge transport compound mixed with an organic resin binder, and a conductive substrate coated therewith.

2. A photosensitive element for electrophotography comprising, within a single layer, a charge generating phase and a charge transport phase, said generating phase comprising a photoconductive organic polycyclic quinone pigment produced by sublimation, said generating phase having a charge generating substance in a resin binder and said transport phase having a charge transport compound in a resin binder.

3. A photosensitive element according to claim 2, wherein said organic pigment is an anthanthrone derivative.

4. A photosensitive element according to claim 2, wherein said organic pigment is a dibenzpyrenequinone derivative.

5. A photosensitive element according to claim 2, wherein said organic pigment is a pyranthrone derivative.

6. A layered photosensitive element for electrophotography having a charge photosensitive layer which comprises a dispersion of a photoconductive organic polycyclic quinone pigment produced by sublimation at a temperature of at least 210° C.

7. The photosensitive element of claim 6 wherein said sublimation is at about 350° C.

8. A photosensitive element according to claim 1, wherein said organic pigment is an anthanthrone derivative.

9. A photosensitive element according to claim 1, wherein said organic pigment is a dibenzlpyrenequinone derivative.

10. A photosensitive element according to claim 1, wherein said organic pigment is a pyranthrone derivative.

* * * * *